US009010061B2

(12) United States Patent
Podjadtke

(10) Patent No.: US 9,010,061 B2
(45) Date of Patent: Apr. 21, 2015

(54) LATTICE GIRDER

(71) Applicant: Bochumer Eisenhütte Heintzmann GmbH & Co. KG, Bochum (DE)

(72) Inventor: Rudi Podjadtke, Herne (DE)

(73) Assignee: Bochumer Eisenhütte Heintzmann GmbH & Co. KG, Bochum (DE)

( * ) Notice: Subject to any disclaimer, the term of this patent is extended or adjusted under 35 U.S.C. 154(b) by 0 days.

(21) Appl. No.: 14/016,800

(22) Filed: Sep. 3, 2013

(65) Prior Publication Data

US 2014/0069047 A1 Mar. 13, 2014

(30) Foreign Application Priority Data

Sep. 11, 2012 (DE) ..... 10 2012 108 471

(51) Int. Cl.

| | |
|---|---|
| ***E04C 5/06*** | (2006.01) |
| ***E21D 11/10*** | (2006.01) |
| ***E04C 3/08*** | (2006.01) |
| *E04C 3/02* | (2006.01) |
| *E04C 3/30* | (2006.01) |
| *E04C 3/04* | (2006.01) |

(52) U.S. Cl.

CPC ... *E04C 5/06* (2013.01); *E04C 3/02* (2013.01); *E04C 3/30* (2013.01); *E21D 11/107* (2013.01); *E04C 3/08* (2013.01); *E04C 2003/0413* (2013.01); *E04C 2003/0469* (2013.01); *E04C 2003/0495* (2013.01)

(58) Field of Classification Search

CPC ..... E04C 3/04; E04C 3/02; E04C 3/30; E04C 3/32; E04C 5/06

USPC ..... 52/846, 848, 838, 836, 652.1, 653.2, 52/653.1, 654.1

See application file for complete search history.

(56) References Cited

U.S. PATENT DOCUMENTS

| | | | | |
|---|---|---|---|---|
| 1,181,013 | A * | 4/1916 | Inglis | 14/4 |
| 1,472,654 | A * | 10/1923 | Jackson | 52/387 |
| 1,545,129 | A * | 7/1925 | Cook, Jr. | 52/653.2 |
| 1,629,367 | A * | 5/1927 | Thies | 52/456 |
| 2,241,617 | A * | 5/1941 | Rubin | 52/650.1 |
| 3,924,368 | A * | 12/1975 | Pedersen | 52/86 |
| 3,974,777 | A * | 8/1976 | Monne | 104/94 |
| 4,543,761 | A * | 10/1985 | Mockovciak, Jr. | 52/652.1 |
| 5,651,229 | A * | 7/1997 | Wada et al. | 52/693 |
| 6,079,178 | A * | 6/2000 | Fisher | 52/690 |
| 6,745,539 | B1 * | 6/2004 | Heim | 52/651.01 |
| 7,347,030 | B2 * | 3/2008 | Lewison | 52/693 |
| 8,307,609 | B2 * | 11/2012 | Kim | 52/843 |
| 2012/0085041 | A1 * | 4/2012 | Place | 52/173.3 |

FOREIGN PATENT DOCUMENTS

| | | |
|---|---|---|
| DE | 81 25 375.3 | 3/1982 |
| DE | 202010004389 | 8/2010 |

* cited by examiner

*Primary Examiner* — Phi A

(74) *Attorney, Agent, or Firm* — Henry M. Feiereisen LLC

(57) ABSTRACT

A lattice girder for support of a tunnel structure includes coupling elements arranged on ends of the lattice girder. Each coupling element has two sheet-metal strips having each an end formed with a loop. Extending between the coupling elements in a longitudinal direction of the lattice girder are two lower bars and an upper bar arranged to define corners of a triangle in cross section. A framework made of single braces connects the lower bars with the upper bar. Connectors are received in the loops of the sheet-metal strips.

13 Claims, 5 Drawing Sheets

LATTICE GIRDER

CROSS-REFERENCES TO RELATED APPLICATIONS

This application claims the priority of German Patent Application, Serial No. 10 2012 108 471.8, filed Sep. 11, 2012, pursuant to 35 U.S.C. 119(a)-(d), the disclosure of which is incorporated herein by reference in its entirety as if fully set forth herein.

BACKGROUND OF THE INVENTION

The present invention relates to a lattice girder for tunnel construction.

The following discussion of related art is provided to assist the reader in understanding the advantages of the invention, and is not to be construed as an admission that this related art is prior art to this invention.

Arches that are formed during tunnel advancement must be supported with the aid of support trusses that are shaped to suit the excavation geometry. During subsequent lining with shotcrete, the individual support trusses are surrounded by concrete. The use of metallic lattice girders as frameworks has proven useful as opposed to the use of solid profiles for the support truss. Lattice girders save material and weight while exhibiting no unconsolidated areas or voids as opposed to solid wall profiles which encounter spray shadows. The individual lattice girders are assembled on site to form juxtaposed lattice arches in circumferential direction of the excavation. The shotcrete lining is homogenous due to the open structure of the lattice arch. The various lattice girders provide high bonding quality with the shotcrete lining and reliable level of support in tunneling.

It would be desirable and advantageous to provide an improved lattice girder which obviates prior art shortcomings and which can be constructed for simple connection with further lattice girders so as to enable easy storage, transport and stacking capability of several lattice girders.

SUMMARY OF THE INVENTION

According to one aspect of the present invention, a lattice girder for support of a tunnel structure includes coupling elements arranged on ends of the lattice girder, each coupling element having two sheet-metal strips having each an end which is formed with a loop, two lower bars and an upper bar extending in a longitudinal direction of the lattice girder between the coupling elements and defining corners of a triangle in cross section, a framework made of single braces to connect the lower bars with the upper bar, and connectors received in the loops of the sheet-metal strips.

A lattice girder according to the present invention has many advantages. Apart from easy storage and transport, the initial flat configuration of the coupling elements in the form of sheet-metal strips in combination with the terminal loops results in outer dimensions at the ends of the lattice girder that make possible a stacking of the lattice girder into the open area of a further lattice girder. The stacking capability improves storage and effective use of available transport space, e.g. of a truck, so that at least twice as many lattice girders can be stacked compared to conventional lattice girders. As a result, storage and shipment costs for lattice girders according to the invention are significantly reduced.

The absence of any angle pieces as couplers promotes stacking capability because there are no webs that extend at a right angle to the bars and would immediately contact the lower bars of a neighboring truss when the lattice girders are stacked. The flat configuration of the sheet-metal strips upon the bars results is a significant reduction of the outer dimensions of the coupling elements. Also the presence of the terminal loops in the region of the upper bar and the lower bars provide sufficient clearance there between to enable entry of the lower bars of a neighboring lattice girder. Overall, stacked lattice girders nest within one another significantly deeper so that the number of lattice girders that can be stacked can be greatly increased.

The upper bar and the lower bars may have different cross sectional shape, e.g. square, rectangular, oval, or combinations thereof. Currently preferred are round shapes to simplify manufacture. The outer surface area of the various bars may also be textured, as is known in connection with e.g. ribbed or profiled reinforced steel. As a result, the bonding effect of the lattice girder with surrounding concrete is improved.

The loops may be formed by sleeves which are joined with the sheet-metal strip. The length of the loops can basically be sized to suit the width of the sheet-metal strips in longitudinal direction of the lattice girder. Of course, the length of the loops in relation to the width of the sheet-metal strips may also be less so that for example the head of a connector, inserted into the loop, ends flush with the sheet-metal strip.

According to another advantageous feature of the present invention, the sheet-metal strips have each an end portion which can be bent to form the loop. Bending of the end portions of the sheet-metal strips is easy to implement and eliminates the need for any joining processes of the sheet-metal elements with sleeves. Furthermore, the position of the loops is determined solely by the bending process. Thus, besides their position, also their inside diameter for receiving the connectors can be easily defined, without requiring the availability of a number of differently sized sleeves.

According to another advantageous feature of the present invention, the sheet-metal strips can have bevels arranged advantageously in a region of the loops. As a result of the bevels of the sheet-metal strips, the position of the loop can be adjusted in relation to the bars. Besides a widest possible distancing of the loops to the bars, the bevels may also be configured so as to be in close proximity to one of the bars or the sheet-metal strip. The bevel can also be configured so as to provide a line contact of the respective sheet-metal strip with the upper bar and/or the lower bars, with an appropriate welded connection being applied in the respective region.

Without changing the position of the loops in relation to the bars, the presence of the bevels allows adjustment of the respective position to the sheet-metal strip respectively extending between the upper bar and one of the lower bars so as to be able to create a greatest possible clearance for stacking a further lattice girder.

With respect to the position of the loops in the region of the upper bar, it may be advantageous to terminate the loops flush with the upper bar. For that purpose, the two lower bars span an imaginary base plane there between, with the loops of one of the coupling elements in a region of the upper bar and the upper bar being aligned to extend along a plane in parallel relationship to the base plane. This configuration is beneficial in terms of the realization of a support surface which provides the individual lattice girder with sufficient stability when placed on subsoil and minimizes the risk of tilting.

From a static viewpoint, any compressive and tensile forces to be transmitted between the upper bars of two interconnected lattice girders can be better absorbed as the upper bars and the connectors lie substantially on a same line of action. By reducing or even eliminating unnecessary lever arms, the presence of unwanted bending moments in the coupling elements is avoided so that the required material thickness can be reduced to a minimum.

Even though the various sheet-metal strips can be arranged on an inner side of the lower bars, it is currently preferred to secure the sheet-metal strips to the lower bars at their outer sides which face away from one another. As a result, a substantial straight-lined connection of the sheet-metal strips between the upper bar and the respective lower bars is realized, with the necessary loops being arranged in a region next to the two lower bars. This also achieves a greatest possible opening width between opposing sheet-metal strips of a coupling element. This is beneficial in terms of receiving a further lattice girder during stacking.

According to another advantageous feature of the present invention, the framework can have a cross-tie arranged between two of the braces extending from the upper bar to each of the lower bars. The respective cross-tie extends between two braces advantageously at a distance to the upper bar and a respective distance to the lower bars. As a result, the cross-ties are advantageously separated from the various bars so that the triangular pattern formed in cross section by the lattice girder is made smaller. This is realized by shifting the individual cross-ties as base of the triangle away from the lower bars and thus towards the upper bar. This generates a clearance between the lower bars up to below the cross-ties. The cross section of the lattice girder formed by the framework braces and the cross-ties thus corresponds substantially to the shape of an A. Advantageously, the distance to the upper bar and the distance to the lower bars have a ratio of 1:2 to 1:6 in relation to one another. The arrangement of the cross-ties within the stated range results in an efficient ratio of the bending stiffness of the framework braces as realized by the cross-ties in relation to the gained clearance between the lower bars.

When stacking the lattice girders for transport or storage, the upper bar of the lattice girders and part of the braces of the frameworks descend into the created clearance to thereby decrease stacking height. The legs of the lattice girders, formed by the braces, are further stiffened by the cross-ties. The remaining unsupported lever arm of the braces is defined hereby by the position of the cross-ties between the upper bar and the lower bars.

When arranging several cross-ties on the lattice girder, the cross-ties may be identical or of different configuration. Besides a straight configuration, the single cross-tie may also be bent or beveled or have various structures or sudden changes in cross section. Currently preferred is a curved configuration of the cross-tie, in particular when the curved cross-tie is opened towards the lower bars.

As a result, joining sites of the cross-tie with the braces are realized in close proximity to the lower bars whereas the midsection of the cross-tie is shifted as far as possible to the upper bar. Despite the thus-attained sufficient stiffening of interconnected braces, there is still a sufficiently large clearance between the legs of the lattice girder as formed by the braces in order to enable a deep nesting of a further lattice girder between the legs. This improves stacking capability of several lattice girders as the number of stacked lattice girders can be increased while maintaining the same height. Transport is thus more efficient because more lattice girders can be transported to their destination site.

With respect to the position of the cross-tie within the lattice girder, it is advantageous when the cross-tie is arranged in spaced-apart relationship to the base plane such that a distance between the braces below the cross-tie corresponds in relation to the base plane to a maximum outer width between two of the loops in a region of the upper bar. This ensures that the maximum attainable stacking depth of nested lattice girders can be realized, without interference as a result of the position of the cross-ties. The outer width defined by the position of the loops in the region of the upper bar establishes hereby a constraint which limits the insertion of a stacked lattice girder into the adjacent lattice girder. Advantageously, the cross-ties are arranged such that the loops contact both the braces and the cross-tie in the region of the upper bar.

Advantageously, the lattice girder in the shotcrete lining is made of metal. The lower bars and the upper bar are welded with the frameworks that connect the bars, in particular welded with the braces. Opposing braces in transverse direction of the lattice girder may also be connected by welding with the cross-ties that connect them. Advantageously, welding involves resistance spot welding.

A lattice girder according to the present invention can be stored and transported efficiently and requires in terms of static properties only little material use. The configuration of the coupling elements in accordance with the present invention in the form of two sheet-metal strips enables easy nesting of several lattice girders without obstructions. The coupling elements may also be used for providing accurate positioning of a lattice girder stacked in another lattice girder.

The terminal loops can easily be realized by bending end portions of the sheet-metal strips. The length of the loops and the flat disposition of the sheet-metal strips upon the various bars to which they are joined improves the capability to absorb bending moments in the butt area of the lattice girders.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
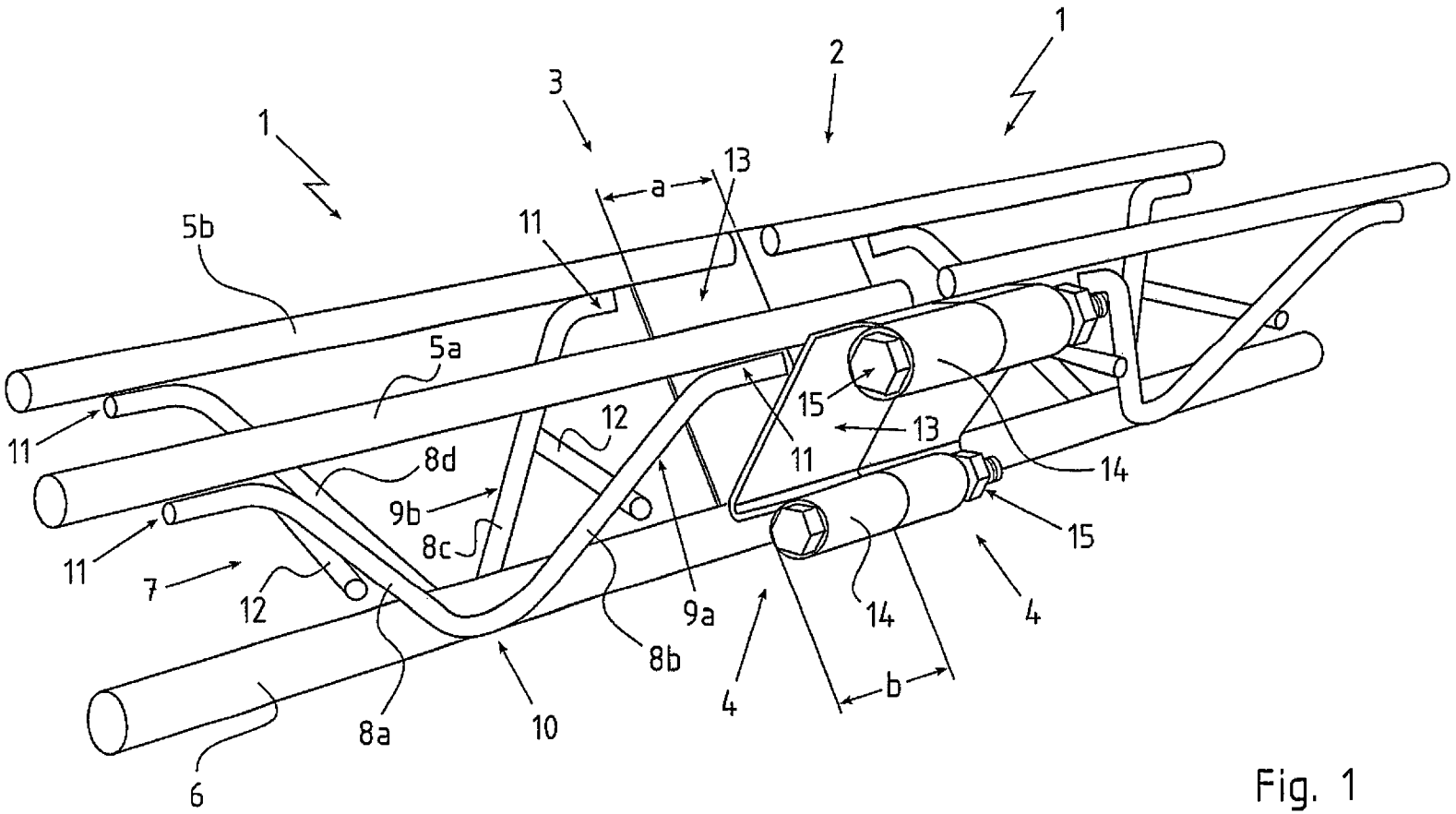
FIG. 1 is a perspective illustration of a lattice girder according to the present invention coupled to a further lattice girder according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective illustration of an end portion of a lattice girder according to the present invention, generally designated by reference numeral 1 and coupled to an end portion of a further lattice girder 1 according to the present invention. The lattice girder 1 can be used for support of a tunnel structure.

The free ends of the two lattice girders 1 in opposite relationship to the coupling site depicted in FIG. 1 are not shown and preferably configured identical so that for sake of simplicity, it can be assumed that the configuration of one end 2 of the lattice girder 1 shown on the right-hand side of FIG. 1 corresponds to the not shown end 2 of the lattice girder 1 illustrated on the left-hand side of FIG. 1. The same applies for the end 3 of the lattice girder 1 illustrated on the left-hand side of FIG. 1 which end 3 corresponds to the not shown end 3 of the lattice girder 1 shown on the right-hand side of FIG. 1. Thus, in a full representation, the ends 2, 3, shown in FIG. 1 are the ends of each of the lattice girders 1.

Each of the lattice girders 1 is provided at its ends 2, 3 with coupling elements 4 via which the lattice girders 1 are connected to one another. Bars in the form of two lower bars 5*a*, 5*b* and an upper bar 6 extend in longitudinal direction of the lattice girders 1 between the terminal coupling elements 4 of the lattice girders 1. The lower bars 5*a*, 5*b* and the upper bar 6 jointly form in cross section of the lattice girder 1 the corner points of a triangle.

In order to secure the various bars 5*a*, 5*b*, 6 in relation to one another at a spaced apart relationship, the lower bars 5*a*, 5*b* are connected by at least one framework 7 with the upper bar 6. The framework 7 includes four braces 8*a*, 8*b*, 8*c*, 8*d* which extend in pairs from the upper bar 6 to the two lower bars 5*a*, 5*b*, with the various braces 8*a*, 8*b*, 8*c*, 8*d* being differently inclined in relation to one another. As a result, a V-formation is established which extends from the upper bar 6 to the two lower bars 5*a*, 5*b*.

The braces 8*a*, 8*b*, 8*c*, 8*d* are combined in two pairs which have each the shape of a simple single-piece bracket, generally designated by reference numerals 9*a*, 9*b*, respectively. The brackets 9*a*, 9*b* are each formed from a single bar having a bend 10 in midsection to thereby define the respective braces 8*a*, 8*b*, 8*c*, 8*d*. At their ends, the braces 8*a*, 8*b*, 8*c*, 8*d* have terminal angled portions 11 configured to extend in parallel relation to the longitudinal direction of the lower bars 5*a*, 5*b*.

The framework 7 is secured to the upper bar 6 via the bend 10 of the brackets 9*a*, 9*b* while the free ends of the braces 8*a*, 8*b*, 8*c*, 8*d* rest with their terminal angled portions 11 upon the periphery of the lower bars 5*a*, 5*b*. The framework 7 is joined in a manner not shown in detail at the contact zones with the lower bars 5*a*, 5*b* and the upper bar 6.

The thus confronting brackets 9*a*, 9*b* of the framework(s) 7 are further interconnected by cross-ties 12. The cross-ties 12 extend between the respective braces 8*a*, 8*b*, 8*c*, 8*d* of the brackets 9*a*, 9*b* and are joined thereto in a manner not shown in detail. The cross-ties 12 are hereby spaced at a distance to the lower bars 5*a*, 5*b* and to the upper bar 6. The distance of the cross-ties 12 in particular to the lower bars 5*a*, 5*b* provides a compromise between static load-carrying capability and maximum clearance to enable an effective stacking capability of several lattice girders 1.

Although not shown in detail, the stacking capability is implemented by placing the respective upper bar 6 of the lattice girders 1 between the lower bars 5*a*, 5*b* of a further lattice girder 1. The further the various lattice girders 1 can be nested within one another, the greater the number thereof while the stacking height remains the same.

As can be clearly seen from FIG. 1, the coupling elements 4 on each of the ends 2, 3 include sheet-metal strips 13. Thus, each coupling element 4 placed at the ends 2, 3 of each of the lattice girders 1 has two sheet-metal strips 13 which extend from the upper bar 6 to each of the lower bars 5*a*, 5*b*. In this position, the individual sheet-metal strips 13 are arranged flatly against the lower bars 5*a*, 5*b* and joined thereto in a manner not shown in detail.

To couple adjacent lattice girders 1, the sheet-metal strips 13 have each at their ends loops 14 for receiving connectors 15. In the non-limiting example of FIG. 1, the loops 14 are shorter than the sheet-metal strips 13, i.e. as viewed in longitudinal direction of the lattice girder 1, the sheet-metal strips 13 are defined by a width a and the loops 14 have a length b, with the length b of the loops 14 being smaller than the width a of the sheet-metal strips 13.

The connectors 15 may be realized in the form of bolts with respective nuts for detachable securement in the loops 14.

Figure 2:
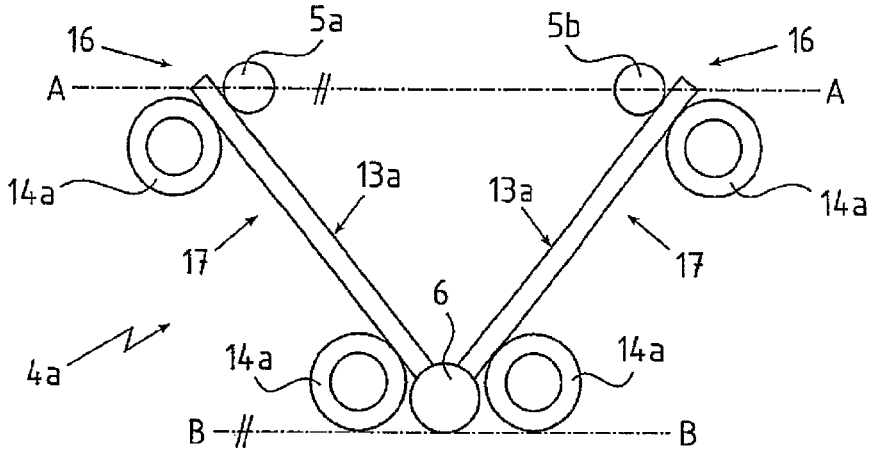
FIG. 2 is a representation of a first embodiment of a terminal coupling element of a lattice girder according to the present invention, as viewed in longitudinal direction of the lattice girder.

FIG. 2 shows a representation of a first embodiment of terminal coupling elements, generally designated by reference numeral 4*a*, of a lattice girder 1 according to the present invention, as viewed in longitudinal direction of the lattice girder. In the following description, parts corresponding with those in FIG. 1 will be identified, where appropriate for the understanding of the invention, by corresponding reference numerals followed by an "a". For sake of simplicity, the representation of the ends 2, 3 of the lattice girder 1 in FIG. 2 and also in the following FIGS. 3 to 7, 9, 10, is limited to the illustration of the upper bar 6 and the lower bars 5*a*, 5*b* in combination with the respective coupling elements 4*a*.

As shown in FIG. 2, the coupling element 4*a* includes two straight sheet-metal strips 13*a* which extend in the form of a V from the upper bar 6 to the respective lower bars 5*a*, 5*b*. The two sheet-metal strips 13*a* point in length direction thereof to the center of the circular upper bar 6 and rest with their ends opposite to the upper bar 6 against the outer sides 16 of the two lower bars 5*a*, 5*b*, with the outer sides 16 facing away from one another. In this configuration, the two sheet-metal strips 13*a* abut obtusely upon the periphery of the upper bar 6 while being in lateral line contact in the region of the lower bars 5*a*, 5*b* with the periphery of the lower bars 5*a*, 5*b* on their outer sides 16. The sheet-metal strips 13*a* are joined in a manner not shown in detail with the upper bar 6 and the lower bars 5*a*, 5*b*.

In the non-limiting example of the coupling elements 4*a* in FIG. 2, the loops 14*a* arranged on the end zones of the sheet-metal strips 13*a* are separate components. The loops 14*a* involve hereby individual tubes or sleeves which are joined in a manner not shown in detail with the outer sides 17 of the sheet-metal strips 13*a*, with the outer sides 17 facing away from one another.

The two lower bars 5*a*, 5*b* span a base plane A there between which extends through the respective center of the two lower bars 5*a*, 5*b*. The loops 14*a* of the coupling element 4*a* lying in the region of the upper bar 6 are hereby positioned together with the upper bar 6 with their periphery upon a common plane B which extends in parallel relation to the base plane A.

Figure 3:
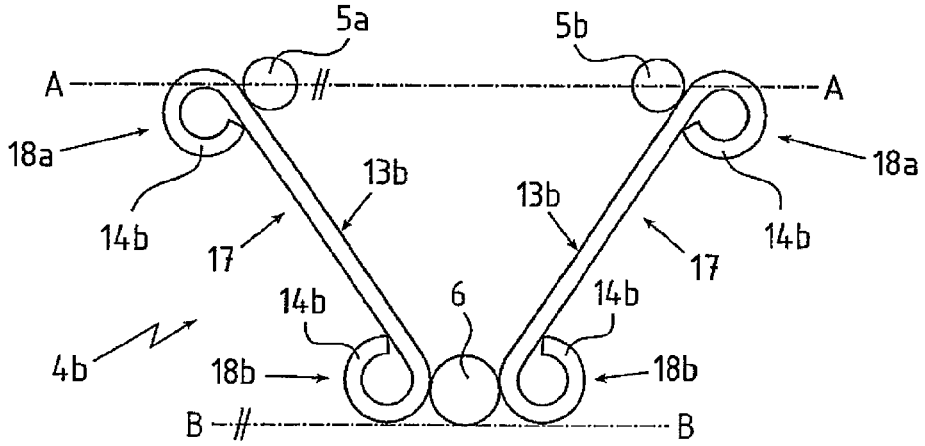
FIG. 3 is a representation of a second embodiment of a terminal coupling element of a lattice girder according to the present invention, as viewed in longitudinal direction of the lattice girder.

FIG. 3 shows a representation of a second embodiment of a coupling element, generally designated by reference numeral 4*b*, of a lattice girder 1 according to the present invention, as viewed in longitudinal direction of the lattice girder. In the following description, parts corresponding with those in FIG. 1 will be identified, where appropriate for the understanding of the invention, by corresponding reference numerals followed by a "b". The coupling element 4*b* has loops 14*b* which are formed by bending the opposite end portions 18*a*, 18*b* of the sheet-metal strip 13*b* accordingly. The end portions 18*a*, 18*b* of the sheet-metal strip 13*b* are bent into a circular shape so that the thus-formed passageway can be used to receive not shown connectors 15.

Depending on the used material thickness of the sheet-metal strips 13*b*, a simple bending of the end portions 18*a*, 18*b* of the sheet-metal strips 13 may be sufficient to produce sufficiently firm loops 14*b*. In addition, the end of the end portions 18*a*, 18*b* which extend in close proximity to the outer sides 17 of the sheet-metal strips 13*b* may be joined a manner not shown in detail with the sheet-metal strips 13*b*.

As a result of such a configuration, as shown in FIG. 3, the sheet-metal strips 13*b* do not abut obtusely upon the upper bar 6, as shown in FIG. 2, but the loops 14*b* formed by bending the end portion 18*b* bear upon the periphery against the upper bar 6. The position of the loops 14*b* in the region of the upper bar 6 corresponds hereby to the position of the loops 14*a* of FIG. 2 and thus on a common plane B with the upper bar 6.

By suitably selecting the position at which the bending of the end portions 18*a* commences in the region of the lower bars 5*a*, 5*b*, the height position of the loops 14*b* can be adjusted in relation to the base plane A. In the non-limiting example of FIG. 3, the opening of the loops 14*b* is shifted in the region of the lower bars 5*a*, 5*b* closer to the base plane A, when compared to the loops 14*a* in FIG. 2.

Figure 4:
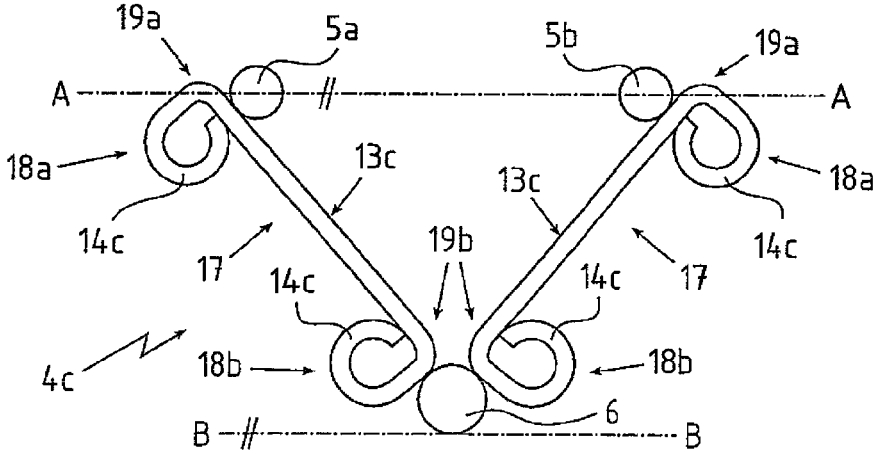
FIG. 4 is a representation of a third embodiment of a terminal coupling element of a lattice girder according to the present invention, as viewed in longitudinal direction of the lattice girder.

FIG. 4 shows a representation of a third embodiment of a coupling element, generally designated by reference numeral 4*c*, of a lattice girder 1 according to the present invention, as viewed in longitudinal direction of the lattice girder. In the following description, parts corresponding with those in FIG. 1 will be identified, where appropriate for the understanding of the invention, by corresponding reference numerals followed by a "c". The coupling element 4*c* has a sheet-metal strip 13*c* with end portions 18*a*, 18*b* which are also bent to form loops 14*c*. In contrast to the sheet-metal strip 13*b* of FIG. 3, the sheet-metal strip 13*c* is further provided with bevels 19*a*, 19*b* in the region of the loops 14*c*. The bevels 19*a*, 19*b* allow adjustment of the respective position of the loops 14*c* in relation to the other sheet-metal strips 13*c*. As can be seen, the respective end portions 18*a*, 18*b* of the sheet-metal strip 13*c* are bent, in particular rolled, to a greater degree as a result of the bevels 19*a*, 19*b*. As a result, the free ends of the end portions 18*a*, 18*b* do not abut against the outer side 17 of the sheet-metal strip 13*c* but are guided past the outer side 17. This leads to a wider center distance between the two lops 14*c* in the area of the lower bars 5*a*, 5*b* in comparison to the embodiment of FIG. 3.

The wider center distance between the loops 14*c* in the region of the lower bars 5*a*, 5*b* is compensated in the region of the upper bar 6, despite the presence of the bevels 19*b* of the sheet-metal strip 13*c*, by shifting the alignment of the sheet-metal strips 13*c* in the region of the upper bar 6 closer to one another. As a result, the sheet-metal strips 13*c* abut in the region of their bevels 19*b* against the periphery of the upper bar 6, with the bent end portions 18*b* buckling towards the outer sides of the sheet-metal strips 13*c* due to the bevels 19*b*. In this configuration, the loops 14*c* no longer rest in the region of the upper bar 6 on the same plane B as the upper bar 6. Rather, the loops 14*c* are shifted in the region of the upper bar 6 inwards closer to the base plane A.

Optionally, the bent end portions 18*a*, 18*b* are joined in the contact area of their free ends upon the outer side 17 of the sheet-metal strip 13*c* in a manner not shown in detail.

Figure 5:
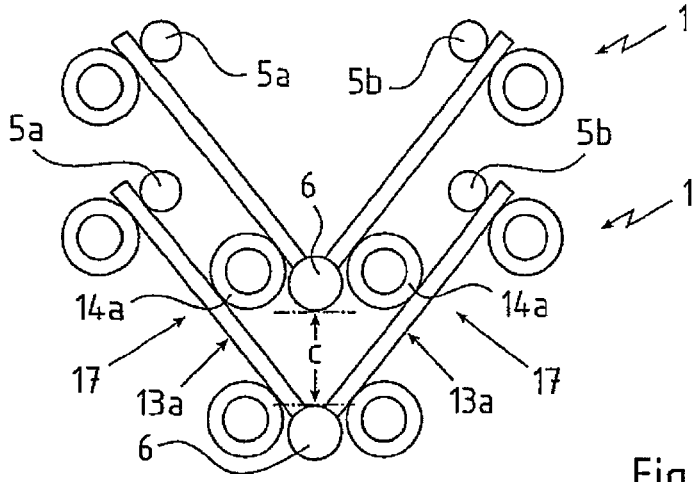
FIG. 5 is a representation of two nested lattice girders with coupling elements of FIG. 2, as viewed in longitudinal direction of the lattice girders.
Figure 6:
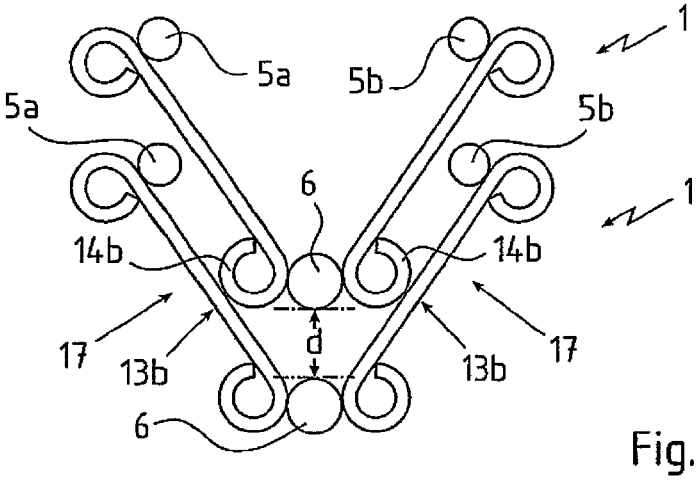
FIG. 6 is a representation of two nested lattice girders with coupling elements of FIG. 3, as viewed in longitudinal direction of the lattice girders.
Figure 7:
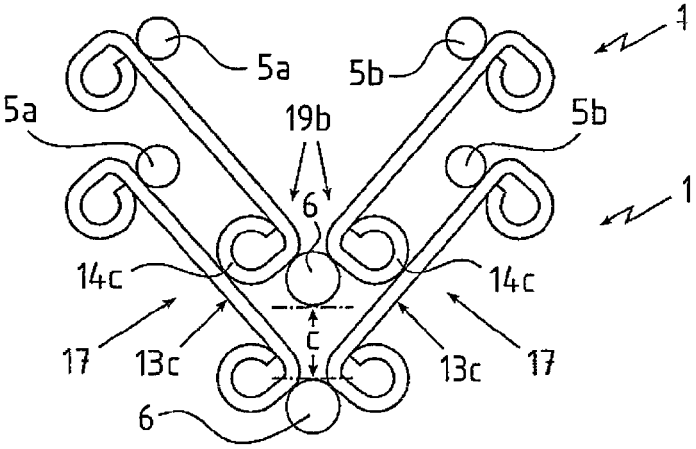
FIG. 7 is a representation of two nested lattice girders with coupling elements of FIG. 4, as viewed in longitudinal direction of the lattice girders.

Referring now to FIGS. 5 to 7, there are shown in analogous sequence of the FIGS. 2-4 the coupling elements 4*a*, 4*b*, 4*c*, respectively, in stacked configuration of two lattice girders 1.

FIG. 5 shows the upper lattice girder 1 with its upper bar 6 placed between the lower bars 5*a*, 5*b* of the lower lattice girder 1. The descent of the upper lattice girder 1 into the lower lattice girder 1 is hereby limited by the arrangement of the loops 14*a* of the upper lattice girder 1 in the region of the upper bar 6. As shown in FIG. 5, when the upper lattice girder 1 descends into the lower lattice girder 1, the loops 14*a* in the region of the upper bar 6 impact at a certain depth on the inner side of the sheet-metal strip 13*a* of the lower lattice girder 1, with the inner side of the lower lattice girder 1 opposing the outer side 17. In this embodiment, the upper bars 6 of the nested lattice girders 1 are spaced from one another by a distance c between their peripheral surfaces.

FIG. 6 also shows two nested lattice girders 1 with coupling elements 4*b* as shown in FIG. 3. The configuration of the loops 14*b* in the upper bar 6 as a result of bending the end portions 18*b* of the sheet-metal strips 13*b* is similar to the configuration of FIG. 5. The upper lattice girder 1 descends into the lower lattice girder 1 to a depth which is defined by the position of the loops 14*b* in the area of the upper bar 6, i.e. when the loops 14*b* during descent of the upper lattice girder 1 contact the inner side of the sheet-metal strips 13*b* of the lower lattice girder 1, with the inner side of the lower lattice girder 1 opposing the outer side 17. The upper bars 6 of the nested lattice girders 1 are hereby spaced from one another at a distance d which is smaller than the distance c between the upper bars 6 in the configuration of FIG. 5. The reason for this resides in the greater opening width between the opposite sheet-metal strips 13*b* of the lower lattice girder 1 in comparison to the embodiment of the coupling element 4*a* in FIG. 5. In this way, the upper lattice girder 1 is able to descend deeper into the lower lattice girder 1, even though the distance of its loops 14*b* is substantially the same in the region of the upper bar 6.

FIG. 7 shows two nested lattice girders 1 with coupling elements 4*c* as shown in FIG. 4. The position of the loops 14*c* in the region of the lower bars 6 results in a similar nesting depth of the upper lattice girder 1 in the lower lattice girder 1, as shown in FIG. 5. This is due to the bevels 19*b* of the sheet-metal strips 13*c* in the region of the upper bar 6 so that the loops 14*c* do not lie in the region of the upper bar 6 on the common plane B with the upper bar 6 and the opposing sheet-metal strips 13*c* of the lower lattice girder 1 are positioned closer together. As a result of the thus-reduced opening width, the distance c between the upper bars 6 of the lattice girders 1 enables a similar stacking height with same number of lattice girders 1, as described above with reference to FIG. 5.

Figure 8:
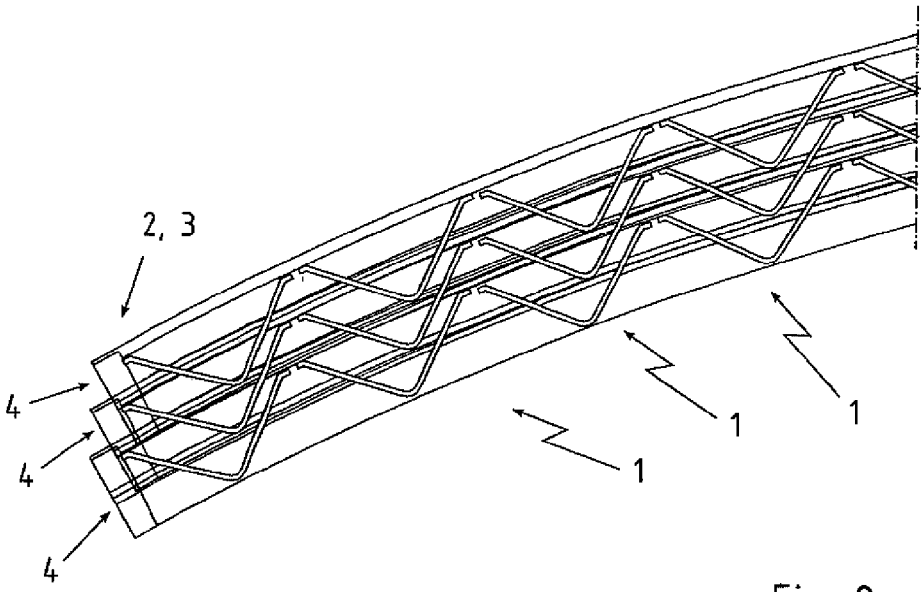
FIG. 8 is a schematic side view of an end portion of three stacked and nested lattice girders according to the present invention.

FIG. 8 is a schematic side view of three stacked and nested lattice girders 1. For ease of illustration, only the end portions of the lattice girders 1 are depicted. Despite the curved shape of the lattice girders 1, contact points are created between their terminal coupling elements 4 resulting in a superior stacking capability that could not be realized with conventionally designed coupling elements.

As shown in particular in FIGS. 5 to 7, the novel design of the coupling elements 4*a*, 4*b*, 4*c* enables the respective lower bars 5*a*, 5*b* to extend to the clearance between the respective loops 14*a*-14*c* in the region of the outer side 17 of the sheet-metal strips 13*a*-13*c* so that there is no interference as a result of sheet-metal strips that are oriented perpendicular to the longitudinal direction of the lattice girders 1.

Figure 9:
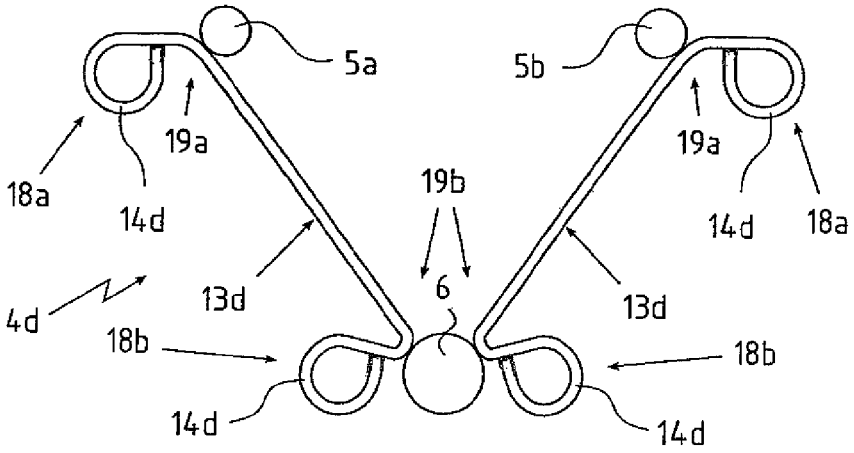
FIG. 9 is a representation of a fourth embodiment of a terminal coupling element of the lattice girder according to the present invention, as viewed in longitudinal direction of the lattice girder.

FIG. 9 is a representation of a fourth embodiment of a coupling element, generally designated by reference numeral 4*d*, of a lattice girder 1 according to the present invention, as viewed in longitudinal direction of the lattice girder. In the following description, parts corresponding with those in FIG. 1 will be identified, where appropriate for the understanding of the invention, by corresponding reference numerals followed by a "d". In this embodiment, the sheet-metal strips 13*d* are secured in the region of their bevels 19*a*, 19*b* to both the upper bar 6 and the lower bars 5*a*, 5*b*. In these regions, the sheet-metal strips 13*d* are joined to the upper bar 6 and the lower bars 5*a*, 5*b* in a manner not shown in detail.

The configuration of the coupling element 4*d* results in a further widening between the opposing loops 4*d* of the two sheet-metal strips 13*d*. In addition, the respective end portions 18*a*, 18*b* of the sheet-metal strips 13*d* are bent to such an extent that their free ends impact a section between the end portions 18*a*, 18*b* and the respective bevels 19*a*, 19*b*. The free ends rest hereby obtusely upon these regions. Optionally, the sheet-metal strips 13*d* may be joined in a manner not shown in detail.

Figure 10:
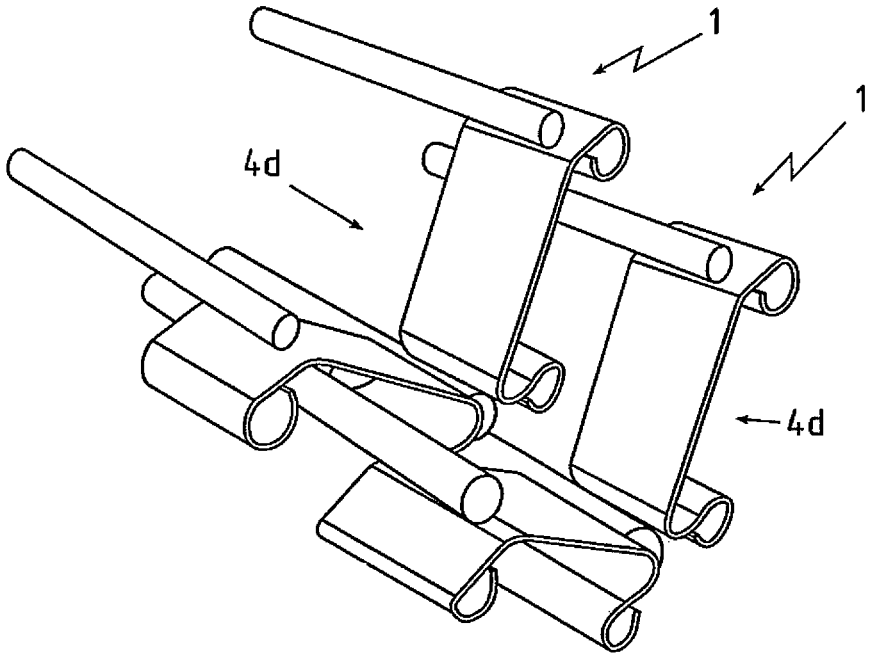
FIG. 10 is a perspective illustration of end portions of two nested lattice girders with the coupling elements of FIG. 9.

FIG. 10 is a perspective illustration of two nested lattice girders 1 coupled to one another by the coupling elements 4*d*.

Figure 11:
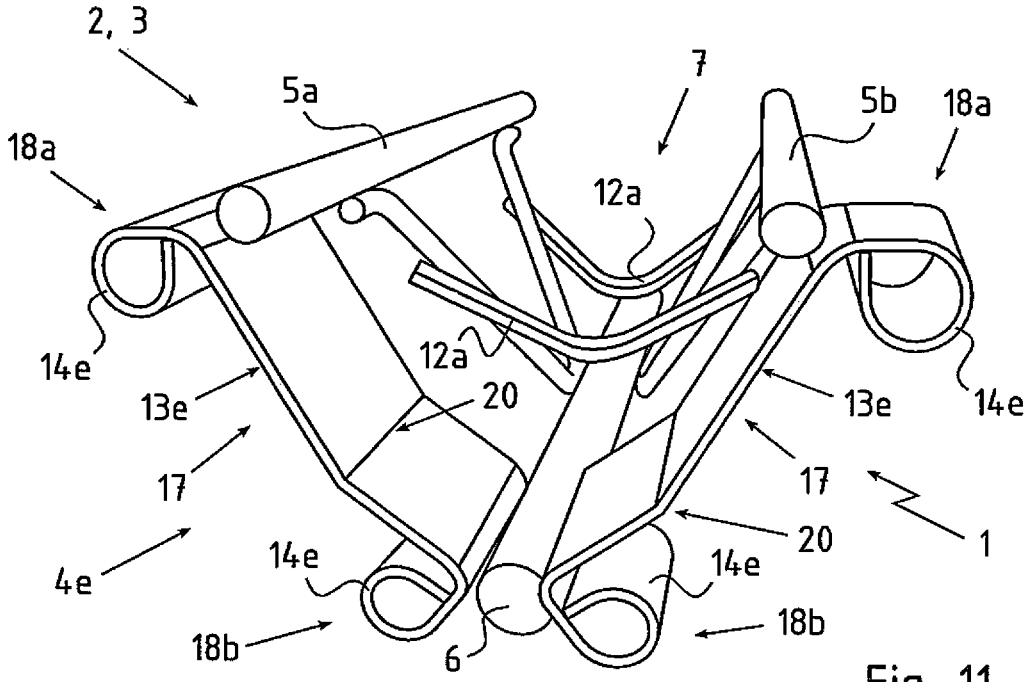
FIG. 11 is a perspective illustration of a fifth embodiment of a terminal coupling element of a lattice girder according to the present invention, as viewed in longitudinal direction of the lattice girder.

FIG. 11 is a perspective illustration of a fifth embodiment of a coupling element, generally designated by reference numeral 4*e*, of a lattice girder 1 according to the present invention, as viewed in longitudinal direction of the lattice girder. In the following description, parts corresponding with those in FIG. 1 will be identified, where appropriate for the understanding of the invention, by corresponding reference numerals followed by an "e". Compared to the coupling element 4*d* of FIGS. 9 and 10, the coupling element 4*e* is provided in the region of its sheet-metal strip 13*e* with a further bevel 20 situated between the terminal loops 14*e*. The bevel 20 is hereby oriented towards the outer side 17 of the sheet-metal strip 13*e* so as to establish a greater opening width of the lattice girder 1 between its upper bar 6 and both its lower bars 5*a*, 5*b*.

In addition, the end portions 18*b* of the sheet-metal strips 13*e* are bent reversed in direction in the region of the upper bar 6 in comparison to the configuration in FIGS. 9 and 10. As a result, the end portions 18*a*, 18*b* are inwardly bent, especially rolled, in the region of the upper bar 6 and in the region of the lower bars 5*a*, 5*b*. In contrast thereto, in the configurations shown in FIGS. 9 and 10, the end portions 18*b* are outwardly bent, especially rolled, in the region of the upper bar 6.

As further shown in FIG. 11, the framework 7 has a cross-tie 12*a* with a curved configuration so that the opening width between the upper bar 6 and the two lower bars 5*a*, 5*b* of the lattice girder 1 is further increased. The cross-tie 12*a* opens hereby towards the lower bars 5*a*, 5*b*.

With respect to the straight configuration of a cross-tie 12, the cross-tie 12 is advantageously distanced from the base plane B such that a distance between the braces 8*a*, 8*b*, 8*c*, 8*d* below the cross-tie from the base plane A corresponds maximally to an outer width between two loops 14, 14*a*-14*e* in the region of the upper bar 6.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A lattice girder for support of a tunnel structure, comprising:

coupling elements arranged on ends of the lattice girder, each coupling element having two sheet-metal strips having each an end formed with a loop configured to receive a connector;

two lower bars and an upper bar extending in a longitudinal direction of the lattice girder between the coupling elements and defining corners of a triangle in cross section; and a framework made of single braces to connect the lower bars with the upper bar, wherein the loop of the coupling elements is positioned such as to allow a stacking of a plurality of said lattice girder.

2. The lattice girder of claim 1, wherein the sheet-metal strips have each an end portion bent to form the loop.

3. The lattice girder of claim 1, wherein the sheet-metal strips have bevels arranged in a region of the loops.

4. The lattice girder of claim 3, wherein the sheet-metal strips are secured to the upper and lower bars in a region of the bevels.

5. The lattice girder of claim 1, wherein the sheet-metal strip are each defined in longitudinal direction by a width, and the loop is defined in the longitudinal direction by a length which is smaller than the width.

6. The lattice girder of claim 1, wherein the two lower bars define a base plane, with the loops of one of the coupling elements in a region of the upper bar and the upper bar aligned to extend along a plane in parallel relationship to the base plane.

7. The lattice girder of claim 1; wherein the sheet-metal strips are secured to the lower bars at their outer sides which face away from one another.

8. The lattice girder of claim 1, wherein the framework has a cross-tie arranged between two of the braces extending from the upper bar to each of the lower bars.

9. The lattice girder of claim 8, wherein the cross-tie has a curved configuration, with the cross-tie opening towards the lower bars.

10. The lattice girder of claim 8, wherein the two lower bars define a base plane, said cross-tie arranged in spaced-apart relationship to the base plane such that a distance between the braces below the cross-tie corresponds in relation to the base plane to a maximum outer width between two of the loops in a region of the upper bar.

11. The lattice girder of claim 1, wherein the sheet-metal strips have each opposite end portions bent counter clockwise to form respective loops pointing in a same direction.

12. The lattice girder of claim 11, wherein the sheet-metal strips have each a bevel arranged in a region of the loops, each said end portion having a free end resting obtusely upon a region between the end portion and the bevel of the sheet-metal strips.

13. The lattice girder of claim 1, wherein the loop of each of the sheet-metal strips is arranged on an outside of the lower and upper bars.

* * * * *